US006588484B1

(12) United States Patent
Fosaaen et al.

(10) Patent No.: US 6,588,484 B1
(45) Date of Patent: Jul. 8, 2003

(54) CERAMIC CASTING CORES WITH CONTROLLED SURFACE TEXTURE

(75) Inventors: Ken Ervin Fosaaen, Morristown, TN (US); Rodney S. Haaland, Morristown, TN (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/597,311

(22) Filed: Jun. 20, 2000

(51) Int. Cl.[7] ..... B22C 9/10
(52) U.S. Cl. ..... 164/28; 164/369; 164/228
(58) Field of Search ..... 164/15, 34, 516, 164/520, 523, 529, 349, 361, 365, 369, 23, 28, 46, 138, 33, 228; 264/629, 632, 635; 451/29, 61

(56) References Cited

U.S. PATENT DOCUMENTS

| | | | | | |
|---|---|---|---|---|---|
| 3,981,688 | A | | 9/1976 | Telang et al. | 29/156.4 WL |
| 4,284,121 | A | | 8/1981 | Horton | 164/520 |
| 4,561,491 | A | | 12/1985 | Slack | 164/516 |
| 4,572,273 | A | | 2/1986 | Katashima | 164/158 |
| 4,798,237 | A | * | 1/1989 | Nakano | 164/255 |
| 5,067,548 | A | | 11/1991 | Uram | 164/15 |
| 5,126,529 | A | * | 6/1992 | Weiss et al. | 219/121.6 |
| 5,173,229 | A | * | 12/1992 | Miyamoto | 264/59 |
| 5,256,179 | A | | 10/1993 | Crooker et al. | 65/60.2 |
| 5,296,308 | A | * | 3/1994 | Caccavale et al. | 428/586 |
| 5,394,932 | A | | 3/1995 | Carozza et al. | 164/137 |
| 5,404,930 | A | | 4/1995 | Stanton et al. | 164/122.1 |
| 5,455,078 | A | * | 10/1995 | Kanzaki | 427/446 |
| 5,465,780 | A | | 11/1995 | Muntner et al. | 164/516 |
| 5,611,670 | A | | 3/1997 | Yoshinari et al. | 416/241 R |
| 5,645,781 | A | * | 7/1997 | Popovic' et al. | 264/639 |
| 5,690,759 | A | * | 11/1997 | Wang | 249/114.1 |
| 5,697,418 | A | | 12/1997 | Bardot et al. | 164/28 |
| 5,738,819 | A | | 4/1998 | Feagin | 264/635 |
| 6,374,898 | B1 | * | 4/2002 | Vogeler et al. | 164/28 |
| 6,422,920 | B1 | * | 7/2002 | Bouten et al. | 451/29 |

FOREIGN PATENT DOCUMENTS

| | | | | |
|---|---|---|---|---|
| EP | 0 660 360 A2 | * | 6/1995 | H01J/9/14 |

* cited by examiner

*Primary Examiner*—M. Alexandra Elve
*Assistant Examiner*—Kevin P. Kerns

(57) ABSTRACT

A method of making a ceramic core is provided wherein the ceramic core is grit blasted using abrasive grit media particulates directed at the core through a preformed apertured mask or pattern to impart a controlled pattern of surface concavities to the core surface by impingement of the abrasive grit media thereon. Another method of making a ceramic casting core is provided wherein the ceramic core is formed in a molding die having a fugitive textured mask or a permanent textured insert positioned on the die surface to impart a controlled surface texture or roughness to the core surfaces.

8 Claims, 4 Drawing Sheets

CERAMIC CASTING CORES WITH CONTROLLED SURFACE TEXTURE

FIELD OF THE INVENTION

The present invention relates to ceramic cores for casting hollow metal castings and, more particularly, to a method of making ceramic casting cores having a controlled surface texture that will be imparted to internal passages of castings cast about the core.

BACKGROUND OF THE INVENTION

Most manufacturers of gas turbine engines are evaluating advanced turbine airfoils (i.e. turbine blade or vane) which include intricate air cooling channels to improve efficiency of airfoil internal cooling to permit greater engine thrust and provide satisfactory airfoil service life. One approach being evaluated involves increasing the surface roughness of the internal cooling air passages to improve blade cooling efficiency.

An object of the present invention is to provide a method of making a ceramic casting core having a core surface with controlled surface texture that will be imparted to internal passages of a gas turbine engine blade or other cast component cast about the core.

SUMMARY OF THE INVENTION

The present invention provides in one embodiment a method of making a ceramic core wherein the ceramic core is grit blasted using abrasive grit media directed at the core through a preformed apertured mask or pattern to impart a controlled pattern of concavities (depressions) on the core surface by impingement of the abrasive grit media thereon while maintaining the desired overall core configuration or contour. Ceramic cores made by injection molding, transfer molding, or pouring can be grit blasted in this manner in the green (unfired) condition or in the fired condition. The apertured mask or pattern can comprise an apertured screen, woven or knitted cloth, paper, plastic or other material which can be temporarily adhered on the core.

The present invention provides in another embodiment a method of making a ceramic casting core wherein the ceramic core is formed in a molding die having a fugitive liner with a controlled surface texture positioned on the die surface for temporary incorporation on the core surface to impart a controlled surface texture thereto and subsequently removed from the core. Alternately, in another embodiment of the invention, the ceramic core is formed in a molding die having a textured die insert that remains with the die and imparts a controlled surface texture to the surface of the ceramic core as it is molded in the die.

The present invention is advantageous in that ceramic cores can be formed with a controlled surface texture or roughness morphology that is imparted to internal cooling air passages of a turbine blade cast about the core while maintaining the overall desired core configuration.

DESCRIPTION OF THE INVENTION

An embodiment of the invention provides a method of making a ceramic casting core C with a controlled surface morphology by directing abrasive grit media (i.e. abrasive particulates) at the core through a preformed apertured mask or pattern. The overall core configuration or contour is maintained with only the core surfaces being blasted to impart the controlled surface morphology thereto. For example, if the core has an airfoil region 10, FIG. 1, that is grit blasted as described above to impart the controlled surface morphology thereto, the core retains the overall configuration or contour of the airfoil region 10 after the grit blasting operation.

Ceramic cores made by injection molding, transfer molding, pouring or other core-forming techniques can be grit blasted in this manner in the green (unfired) condition or in the fired condition. For example, a poured ceramic core is formed by the sequence of steps of mixing ceramic slurry with a catalyst, pouring the mixture in a die, and applying pressure until the core sets up, and then removing the green core from the die. The green core then can be subjected to a flaming operation where the green core is impinged with an alcohol flame followed by a high temperature sintering operation. A poured core can be grit blasted pursuant to the invention after removal from the molding die following the flaming operation or after high temperature sintering of the core. An injection or transfer molded ceramic core is molded by injecting a ceramic slurry including a thermoplastic or thermosetting binder into a die to form a green core. The injection or transfer molded core likewise can be grit blasted after removal from the molding die or after high temperature sintering of the core.

Figure 1:
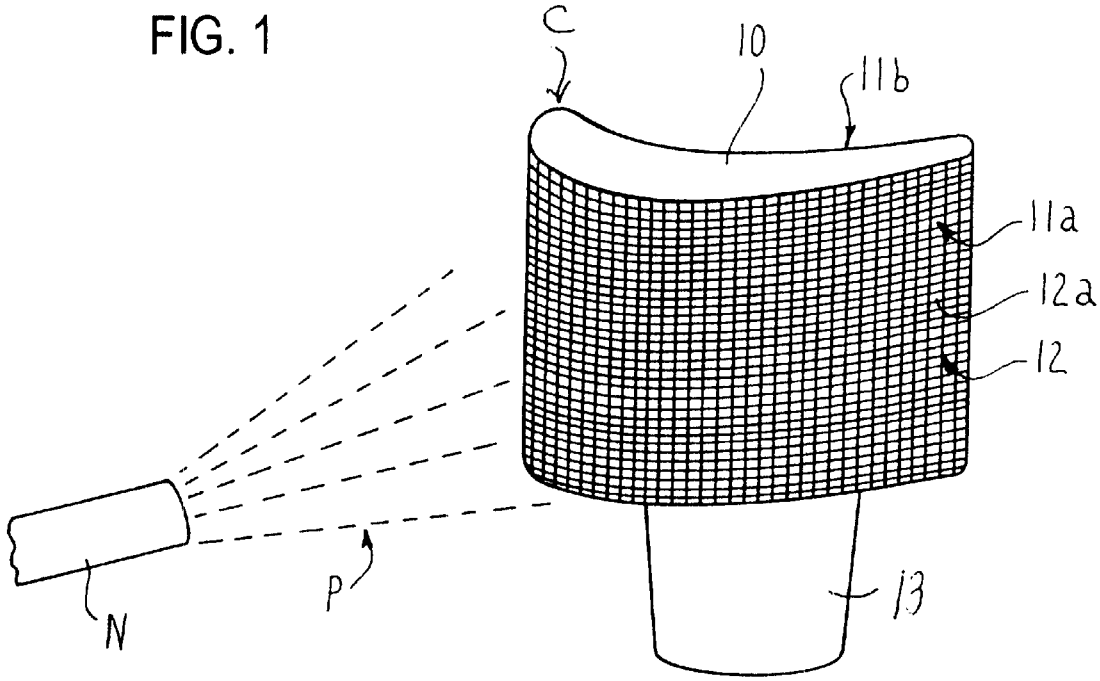
FIG. 1 is a schematic view of a turbine blade core having an apertured mask adhered on an airfoil region and through which abrasive grit is directed from a grit blasting machine nozzle.

Referring to FIG. 1, a green or sintered airfoil shaped ceramic core C with a core print extension 13 is shown schematically as having an apertured mask or pattern 12 adhered on a convex airfoil core surface 11*a* of airfoil region 10 to be roughened or textured and a discharge nozzle N of a conventional grit blasting machine. The mask or pattern 12 can comprise an apertured flexible woven or knitted cloth, fiberglass, paper, plastic or other apertured material such as a screen that can conform to the core surface 11*a* and can be adhered on the core surface by adhesive. The adhesive can comprise Repositionable 75 Spray Adhesive available from 3M Corporation. Abrasive grit particles P are discharged from a nozzle N of the grit blasting machine to direct the abrasive particles through the pattern 12 to impinge on the core surface 11*a* in a manner to abrade away core material therefrom where apertures 12*a* are present in the pattern 12 such that the core surface 11*a* becomes controllably roughened with surface depressions in a pattern or texture dictated by the pattern of apertures 12*a* the mask or pattern 12. The grit blasting can be effected manually or using robotic control of grit spray motion and using a volumetric grit powder feeder to enhance control of the grit blasting operation, although any conventional grit blasting equipment can be used to practice the invention. After grit blasting operation, the pattern 12 is removed from the grit blasted core surface 11*a* by lifting it off of the core surface. The concave airfoil core surface 11*b* can be grit blasted in the same manner to impart a controlled roughness or texture thereto.

Figure 2:
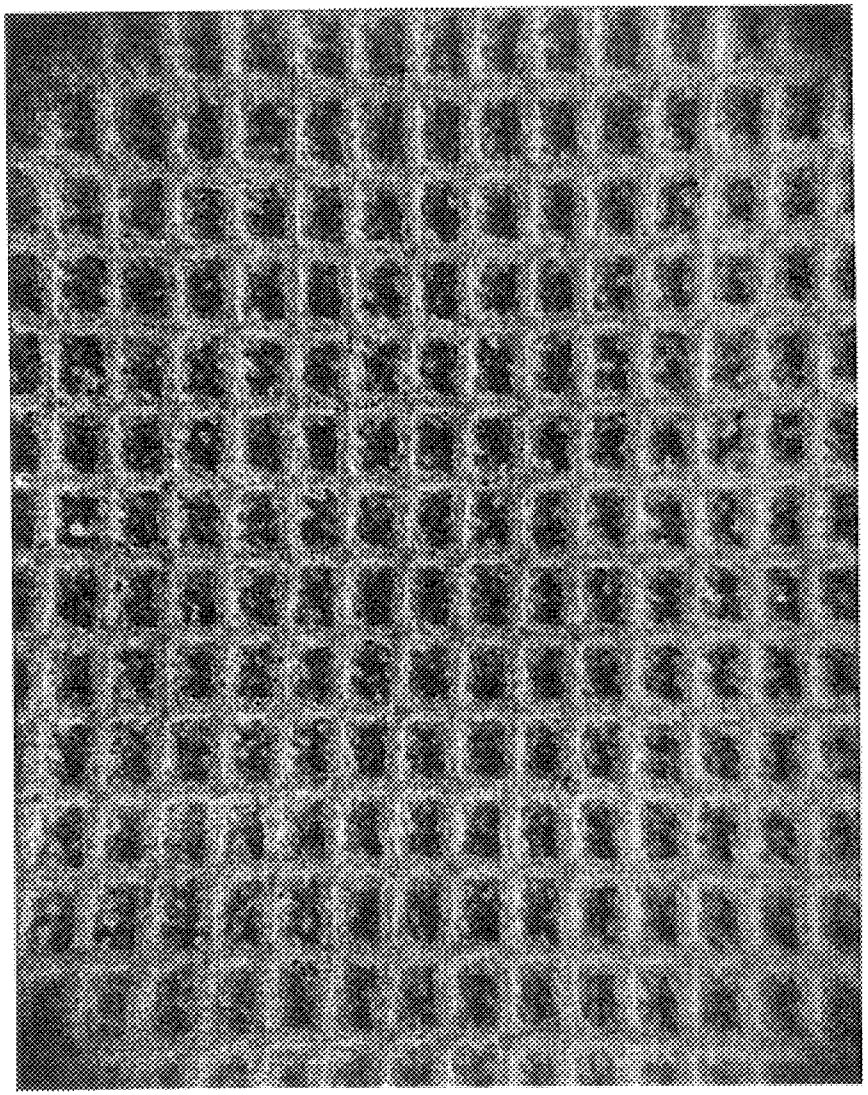
FIG. 2 is a photograph at approximately 6× of a core surface controllably roughened pursuant to the invention.

For purposes of illustration only and not limitation, a green or fired ceramic core (e.g. fused silica ceramic core having a configuration to form internal cooling passages in a gas turbine engine blade) was grit blasted with a pattern 12 adhered directly on a core surface by the repositionable adhesive described above. The pattern 12 comprised a plastic coated fiberglass screen (e.g. a conventional screen for a door) having a uniform distribution of apertures having a 1.0 by 1.5 millimeters (mm) aperture size. Fine tabular alumina grit particles (320 grit or mesh) were directed at the core surface through the apertured screen from a discharge nozzle of grit blasting machine available as model CS36-36C from Kelco Corporation, Norwalk, Calif. The nozzle was held manually a distance of 4 to 6 inches from the core surface and operated at an air pressure of 20 psi to spray the tabular alumina particles at the core surface. Such grit blasting produced a controlled pattern of 1.0 by 1.5 mm surface depressions bounded by raised walls or regions on the core surface as shown in FIG. 2. The overall outer configuration or contour of the core was not adversely affected by the grit blasting operation.

Figure 3:
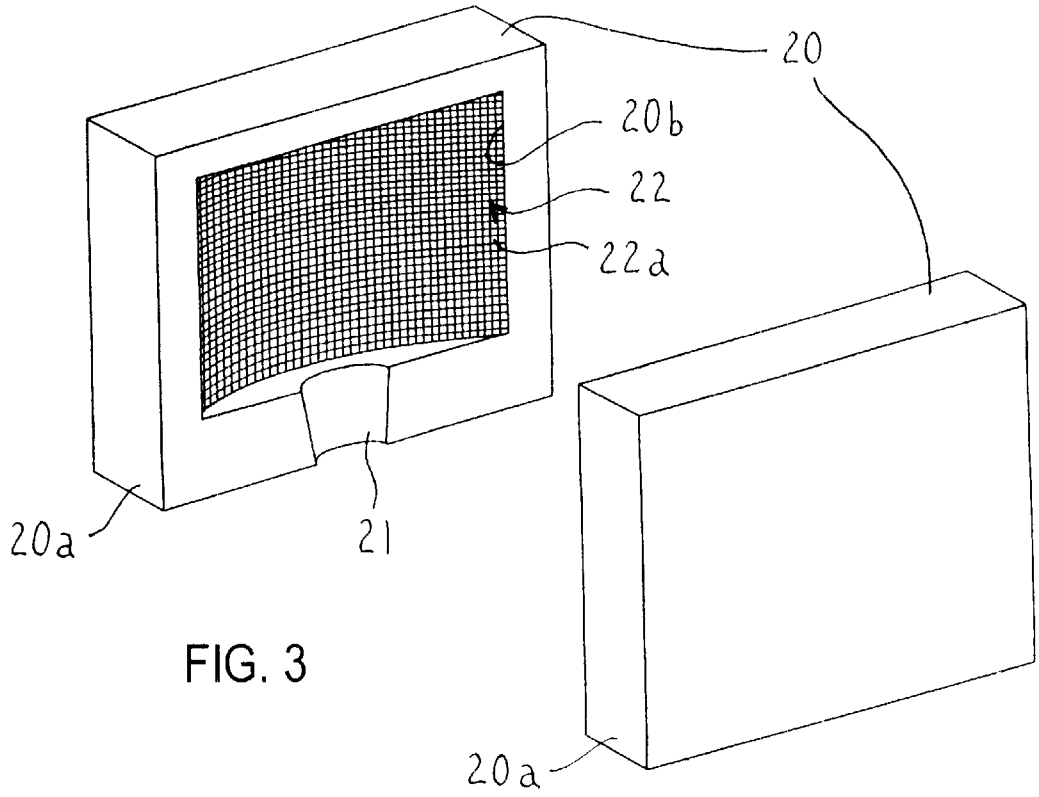
FIG. 3 is a schematic view of a core molding die having a fugitive textured pattern liner adhered on the die surface to impart a controlled texture to the surface of the core.

Still another embodiment of the invention is illustrated in FIG. 3 where a molding die 20 for a ceramic core shown schematically includes a fugitive mask or pattern 22 (one shown) having a controlled surface texture positioned as a liner on a respective inner surface 20*b* of each die half 20*a* for temporary incorporation on opposite core surfaces corresponding to surfaces 11*a*, 11*b* of FIG. 1 to impart a controlled surface texture or morphology thereto and subsequently removed from the core by burning or other technique. The fugitive mask or pattern 22 may comprise an apertured textile cloth, screen, stencil and the like having small scale geometric uniform pattern of apertures 22*a* to impart a controlled pattern of relatively low surface concavities and relatively high surface regions to the core surfaces. The mask or pattern 22 also can comprise a non-apertured fugitive (e.g. plastic, paper, etc.) liner with controlled surface texture having a plurality of relatively low and high surface regions to be imparted to the core surface.

For example only, a low ash combustible apertured cloth with a desired weave or knit (e.g. woven or knitted cotton or rayon cloth) is precut to the desired shape to fit on and line the molding surfaces 20*b* of the molding die halves 20*a*. The die molding surfaces 20*b* are cleaned and, if necessary, sprayed with a repostionable adhesive described above to affix the apertured liner on the die surfaces. A ceramic slurry comprising appropriate ceramic powders and binder for the particular core application carried in a fluid vehicle then is introduced by pouring into the die using conventional poured core forming equipment to form a green core. The green core then is removed from the die after the binder system becomes rigid or solid with the textile or other liner pulling away from the die surfaces to remain embedded in the surface of the green core surface. The textile or other liner then is burned off during a conventional flaming operation, debinding operation or high temperature sintering operation for the poured core. Removal of the textured liner leaves a controllably textured or roughened core surface where the liner was embedded. A pattern of relatively low surface concavities and relatively higher surface regions thereby can be imparted to the core surface. Any liner material that is not burned off of the core is completely burned away in a subsequent sintering operation where the core is heated to elevated sintering temperatures.

Figure 5:
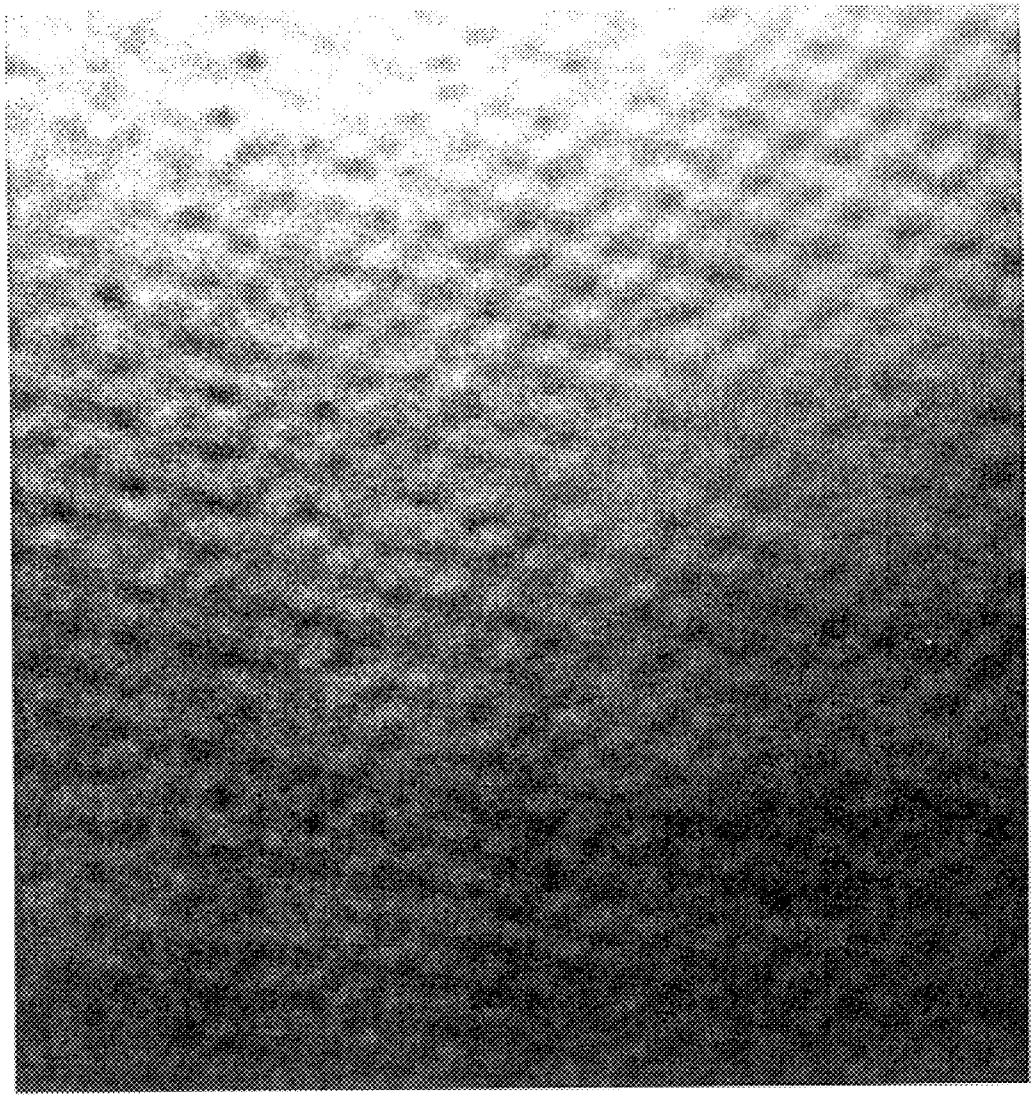
FIG. 5 is a photograph at approximately 6× of a core surface controllably roughened pursuant to another embodiment of the invention.

For purposes of illustration only and not limitation, molding surfaces 20*b* and core print-forming surface 21 of a die designed to mold a ceramic core for making hollow gas turbine engine blades were cleaned with hexane solvent and each molding surface 20*b* was lined with apertured cotton cloth adhered to the cleaned mold surfaces by the repositionable adhesive described above. A ceramic slurry comprising fused silica and zircon ceramic powders and a catalytically cured ethyl silicate liquid binder was introduced into the die by pouring followed by subsequent pressurization at 100 psi in the die to form a green molded core. The cured green core was removed from the die along with the cotton cloth liners that remained embedded in the core surface. The green core was subjected to a conventional flaming operation where the green core is subjected to an alcohol flame in air that burned off most of the cotton cloth liners from the sides of the core. The core then was sintered at about 1800 degrees F. in air to burn off any remaining cotton cloth liner material and develop core strength for handling through subsequent core processing operations. The core was left with a controllably textured surface morphology, FIG. 5, by virtue of the cotton cloth liners being embedded in the core surface of the green core and then selectively removed from the core. The core surfaces comprised a controlled pattern of relatively low concave surface regions and relatively higher surface regions, as shows in FIG. 5.

Figure 4:
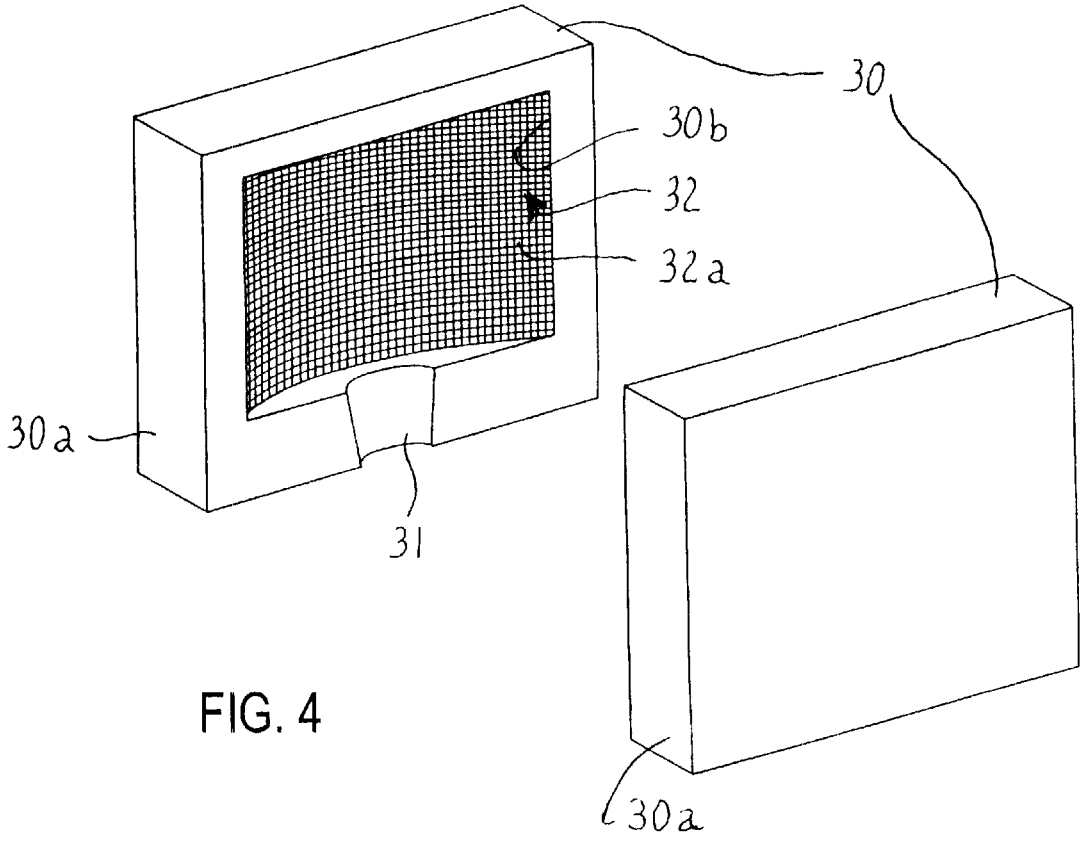
FIG. 4 is a schematic view of a core molding die having a textured pattern insert adhered permanently on the die surface to impart a controlled texture to the surface of the core.

Still a further embodiment of the invention is illustrated in FIG. 4 where a molding die 30 for a ceramic core is shown schematically having a controllably roughened or textured inserts 32 (one shown) positioned on surface 30*b* of each die half 30*a* to form molding surfaces 32*a* thereof together with core print-forming surface 31. The inserts 32 can comprise a thin (e.g. 0.005 to 0.020 inch thick) plastic or metal insert having a desired non-apertured surface texture (roughness) having a predetermined controlled pattern of relatively low and high surface regions and/or an apertured surface such as having a controlled pattern of perforations, holes or other apertures. The inserts 32 can be permanently adhered on each die half 30*a* by an adhesive, such as Fastweld 10 rapid setting epoxy available from Ciba Specialty Chemicals, East Lansing, Mich., and forms the controlled roughness surface cast or molded in situ in the core surfaces corresponding to surfaces 11*a*, 11*b* of FIG. 1 during molding in the die. The inserts 32 remain in the die when the green core is removed.

The ceramic cores produced pursuant to the invention are invested in a ceramic shell mold after the core sintering operation. For example, the ceramic cores are invested in the ceramic shell mold using the well known lost wax process where a wax pattern corresponding to the casting to be made is molded about the sintered core, and the pattern/core assembly is subjected to repeated dips in ceramic slurry, draining of excess slurry, and then stuccoing with coarse ceramic stucco to build up a ceramic shell mold of desired thickness about the pattern/core assembly. The pattern then is selectively removed by melting or other technique to leave a green ceramic shell mold with the core therein. The mold is fired at elevated temperature to develop mold strength for casting. Molten metal such as molten nickel or cobalt based superalloy is cast into the shell mold about the core to form a casting having internal passages formed by the core. When gas turbine engine blades are so investment cast, the internal passages formed by the core define cooling air passages of the hollow blade. The casting then is removed from the shell mold by a mechanical knock-out operation, and the core is removed from the casting by chemical leaching to leave a hollow casting where the internal passages have the controllably roughened or textured surface imparted to the core pursuant to the invention as described above.

It will be apparent to those skilled in the art that various modifications and variations can be made in the embodiments of the present invention described above without departing from the spirit and scope of the invention as set forth in the appended claims.

We claim:

1. A method of making a ceramic core for casting, comprising providing a ceramic core having a core surface and impinging the core surface with abrasive particulates directed at the core surface through a mask with a pattern of apertures for said particulates to pass through said apertures to said core surface to abrade away ceramic material from said core surface and form a corresponding pattern of concavities on said core surface.

2. The method of claim 1 including impinging said abrasive particulates on the core surface with the apertured mask disposed on the core surface.

3. The method of claim 1 wherein the mask is selected from a flexible apertured screen or a flexible apertured cloth conformed to the surface of the ceramic core.

4. A method of making a ceramic core for casting, comprising forming a ceramic core in a molding die having a fugitive liner with a controlled surface texture, said liner being positioned on a die surface for incorporation on a surface of the ceramic core formed in the molding die to impart a controlled surface texture to the surface of the ceramic core, removing the ceramic core from the molding die with the fugitive liner retained on the surface of the ceramic core, and selectively removing the fugitive liner from the surface of the ceramic core.

5. The method of claim 4 wherein the fugitive liner comprises a combustible cloth or a combustible screen.

6. The method of claim 4 wherein the fugitive liner comprises a combustible non-apertured liner with a predetermined pattern of surface regions having different heights.

7. The method of claim 4 wherein the fugitive liner is removed by burning it off of the core surface.

8. A method of making a ceramic core for casting, comprising forming a ceramic core in a molding die having a fugitive liner with a controlled surface texture wherein said fugitive liner comprises a combustible apertured cloth or combustible apertured screen, said fugitive liner being positioned on a die surface for incorporation on a core surface to impart a controlled surface texture to the core surface, removing the core from the molding die with the fugitive liner retained on the core surface, and selectively combusting the fugitive liner to remove it from the core surface.

* * * * *